US010020592B2

(12) United States Patent
Taptič et al.

(10) Patent No.: US 10,020,592 B2
(45) Date of Patent: Jul. 10, 2018

(54) ANTENNA FOR WIRELESS COMMUNICATION

(71) Applicant: RF elements s.r.o., Bratislava (SK)

(72) Inventors: Juraj Taptič, Zálesie (SK); Martin Marcinčák, Jasenov (SK)

(73) Assignee: RF ELEMENTS S.R.O., Bratislava (SK)

( * ) Notice: Subject to any disclaimer, the term of this patent is extended or adjusted under 35 U.S.C. 154(b) by 164 days.

(21) Appl. No.: 14/855,782

(22) Filed: Sep. 16, 2015

(65) Prior Publication Data

US 2016/0079681 A1 Mar. 17, 2016

Related U.S. Application Data

(60) Provisional application No. 62/050,920, filed on Sep. 16, 2014.

(51) Int. Cl.

| | |
|---|---|
| ***H01Q 19/10*** | (2006.01) |
| ***H01Q 1/24*** | (2006.01) |
| ***H01Q 19/02*** | (2006.01) |
| ***H01Q 21/08*** | (2006.01) |

(52) U.S. Cl.

CPC ..... *H01Q 19/104* (2013.01); *H01Q 1/246* (2013.01); *H01Q 19/021* (2013.01); *H01Q 21/08* (2013.01)

(58) Field of Classification Search

CPC ..... H01Q 19/10; H01Q 1/246; H01Q 19/32; H01Q 21/36; H01Q 21/205; H01Q 1/38

USPC ..... 343/834, 798, 795, 797, 799

See application file for complete search history.

(56) References Cited

U.S. PATENT DOCUMENTS

| | | | | |
|---|---|---|---|---|
| 2007/0001923 | A1* | 1/2007 | Slattman | H01Q 1/246 343/872 |
| 2007/0139278 | A1* | 6/2007 | Slattman | H01Q 1/246 343/700 MS |
| 2010/0283707 | A1* | 11/2010 | Foo | H01Q 9/0414 343/872 |
| 2013/0321233 | A1* | 12/2013 | Deng | H01Q 3/16 343/835 |

* cited by examiner

*Primary Examiner* — Dameon E Levi
*Assistant Examiner* — Collin Dawkins
(74) *Attorney, Agent, or Firm* — Ohlandt, Greeley, Ruggiero & Perle, L.L.P.

(57) ABSTRACT

There is provided an antenna that includes (a) an element that emits radiation in a direction, and (b) a structure made of an electrically conductive material. The structure includes (i) a surface situated to a side of the element that is in other than the direction, and (ii) a first wall and a second wall that are situated generally perpendicular to the surface and situated with respect to one another so as to form a trough therebetween.

7 Claims, 16 Drawing Sheets

700

ANTENNA FOR WIRELESS COMMUNICATION

CROSS-REFERENCE TO RELATED APPLICATIONS

The present application is claiming priority of U.S. Provisional Patent Application Ser. No. 62/050,920, filed on Sep. 16, 2014, the content of which is herein incorporated by reference.

BACKGROUND OF THE DISCLOSURE

1. Field of the Disclosure

The present disclosure relates to a configuration of an antenna for a wireless communication.

2. Description of the Related Art

The approaches described in this section are approaches that could be pursued, but not necessarily approaches that have been previously conceived or pursued. Therefore, the approaches described in this section may not be prior art to the claims in this application and are not admitted to be prior art by inclusion in this section.

Performance of an antenna significantly influences overall performance of a communication system. Antenna performance can affect how efficiently scare frequency spectrum is used, and also effect overall performance of particular wireless communication system or wireless data transmission network. In order to cover an area with a signal, an ideal antenna preferably radiates only to a particular target area, i.e., angular coverage, and should not radiate outside of the target area. Real antennas typically radiate outside of the target area, yet a goal of proper antenna design is to minimize such unwanted radiation.

There are several techniques for assessing quality, i.e., performance, of a radiation pattern of an antenna from the area coverage point of view. Besides evaluating a shape of the radiation pattern within some margin, e.g., a radiation pattern envelope mask, there are numerical measures, such as side lobe levels and front-to-back ratio.

In telecommunications, the term front-to-back ratio (also known as front-to-rear ratio) is a ratio of power gain between the front and rear of a directional antenna. It is a ratio of signal strength transmitted in a forward direction to that transmitted in a backward direction.

The present document discloses a technique for improving the performance of an antenna by maximizing the antenna's front-to-back ratio.

SUMMARY OF THE DISCLOSURE

There is provided an antenna that includes (a) an element that emits radiation in a direction, and (b) a structure made of an electrically conductive material. The structure includes (i) a surface situated to a side of the element that is in other than the direction, and (ii) a first wall and a second wall that are situated generally perpendicular to the surface and situated with respect to one another so as to form a trough therebetween. The structure minimizes unwanted radiation outside of a main lobe of the antenna. Minimizing such radiation also improves a front-to back-radio of the antenna.

BRIEF DESCRIPTION OF THE DRAWINGS

A component or a feature that is common to more than one drawing is indicated with the same reference number in each of the drawings.

DESCRIPTION OF THE DISCLOSURE

Figure 1:
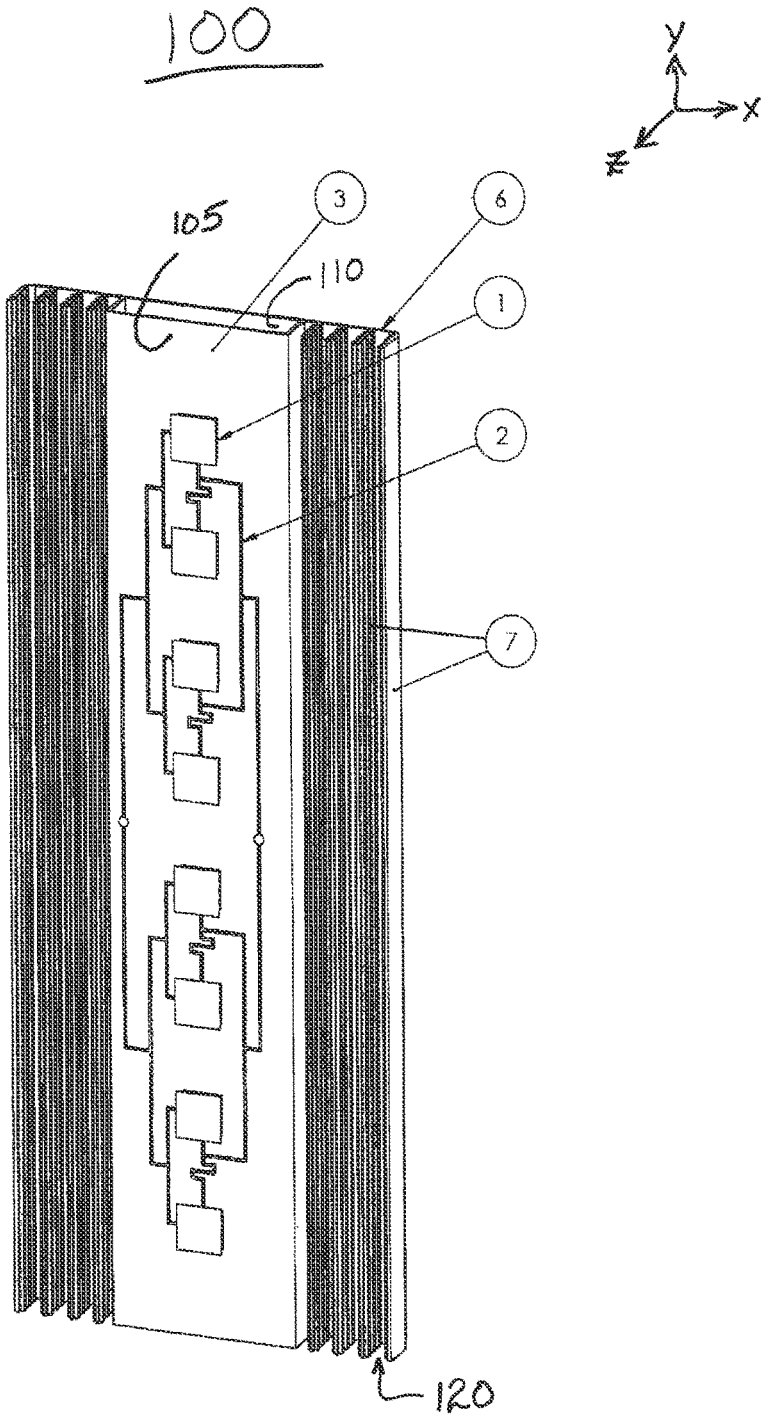
FIG. 1 is an illustration of an antenna.

FIG. 1 is an illustration of an antenna 100 that includes an antenna base 3. Antenna 100 may be configured for single or multiple polarizations, and may be implemented as any form of antenna, e.g., patch or dipole.

Antenna base 3 includes a surface 105, and situated on surface 105 are radiating elements, one of which is designated as radiating element 1 in FIG. 1. Radiating element 1 emits radiation, i.e., a signal, and can be in any suitable form, e.g., a patch or a dipole. In practice, antenna 100 may have any number, i.e., one or more, of radiating elements. Radiating element 1 is fed by a suitable feeding network 2, e.g., a chain of power dividers, that is also situated on surface 105.

FIG. 1 includes a co-ordinate system having an x-axis, a y-axis and a z-axis situated orthogonally to one another. Radiation emitted from antenna 100, and more specifically from radiating element 1, propagates outward in a direction of the z-axis.

Antenna base 3 also includes a structure 6. Structure 6 is made of an electrically conductive material such as a metal, and functions as a reflector. That is, structure 6 reflects electromagnetic waves. Structure 6 minimizes radiation to the backside of antenna 100, and thus maximizes the front-to-back ratio of antenna 100.

Structure 6 has a planar surface 110 and includes a plurality of walls 7. Walls 7 are generally perpendicular to surface 110 and run parallel to one another along a length of structure 6. Walls 7 are thus situated to form one or more troughs 120 therebetween, one of which is identified in FIG. 1. Some of walls 7 are situated on the left side of antenna base 3 and thus to the left of radiating element 1, and some of walls 7 are situated on the right side of antenna base 3 and thus to the right of radiating element 1. In FIG. 1, walls 7 and troughs 120 are shown as extending along a length of structure 6, i.e., along the y-axis, but walls 7 and troughs 120 could extend along a width of structure 6, i.e., along the x-axis.

In FIG. 1, structure 6 is the same length as antenna 100, but in practice, structure 6 may be either longer or shorter than antenna 100. Dimensions of walls 7 and troughs 120 depend on a particular antenna and its operating wavelength. Typically, the height of walls 7 and depth of troughs 120 are around a quarter of a wavelength of the emitted radiation.

Surface 110 is a flat plane that is parallel to surface 105 and situated on sides of radiating element 1 that are other than in the direction of the propagation of radiation. Thus, in antenna 100, surface 110 is situated in, or parallel to, the x-y plane. However, in practice, surface 110 need not be flat, but instead may be configured of other forms, for example, a curved surface or a V-shaped surface, i.e., forms having surfaces that are other than parallel to surface 105.

Figure 2:
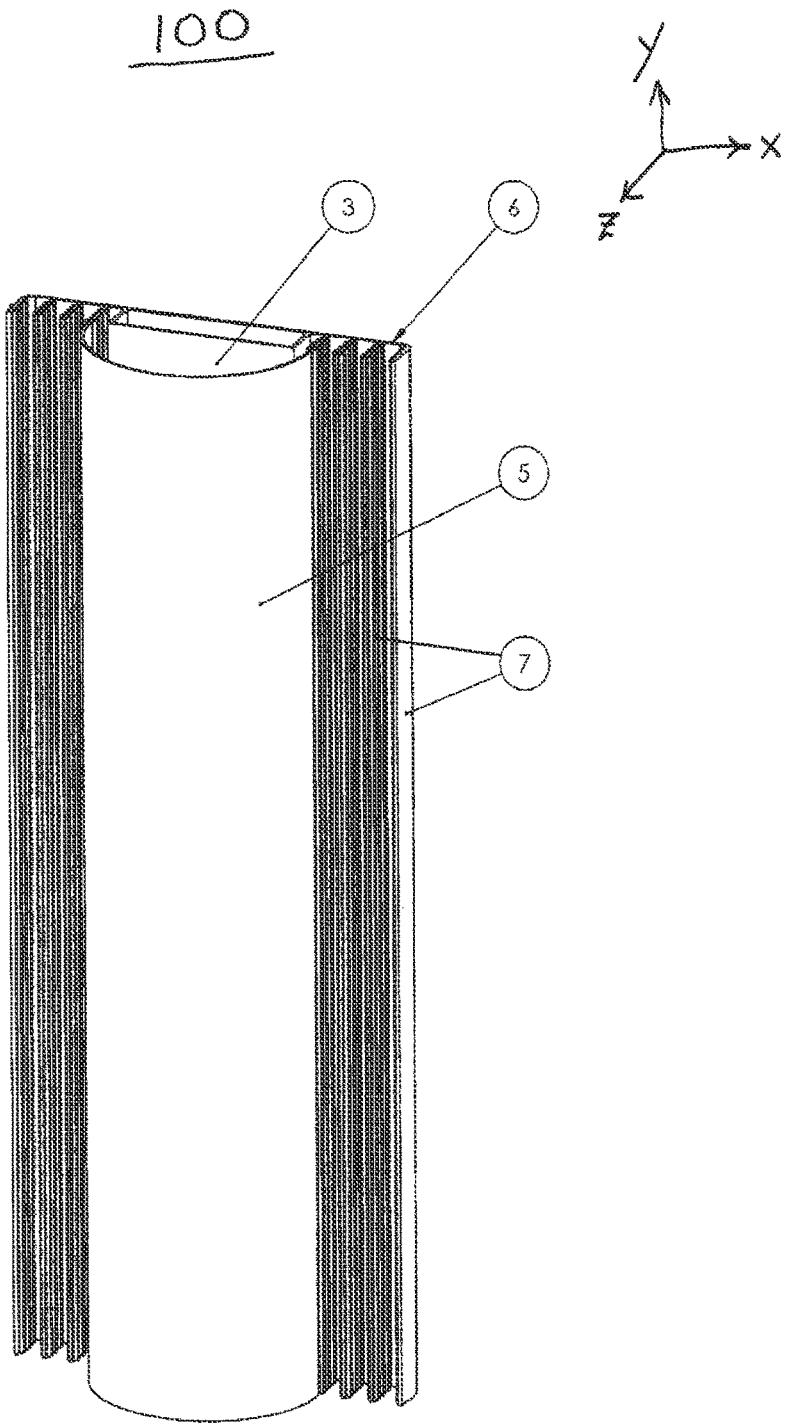
FIG. 2 is an illustration of the antenna of FIG. 1 having a radome.

FIG. 2 is an illustration of antenna 100 having a radome 5 covering radiating element 1 and network 2 to protect radiating element 1 and network 2 from environmental factors.

Figure 3:
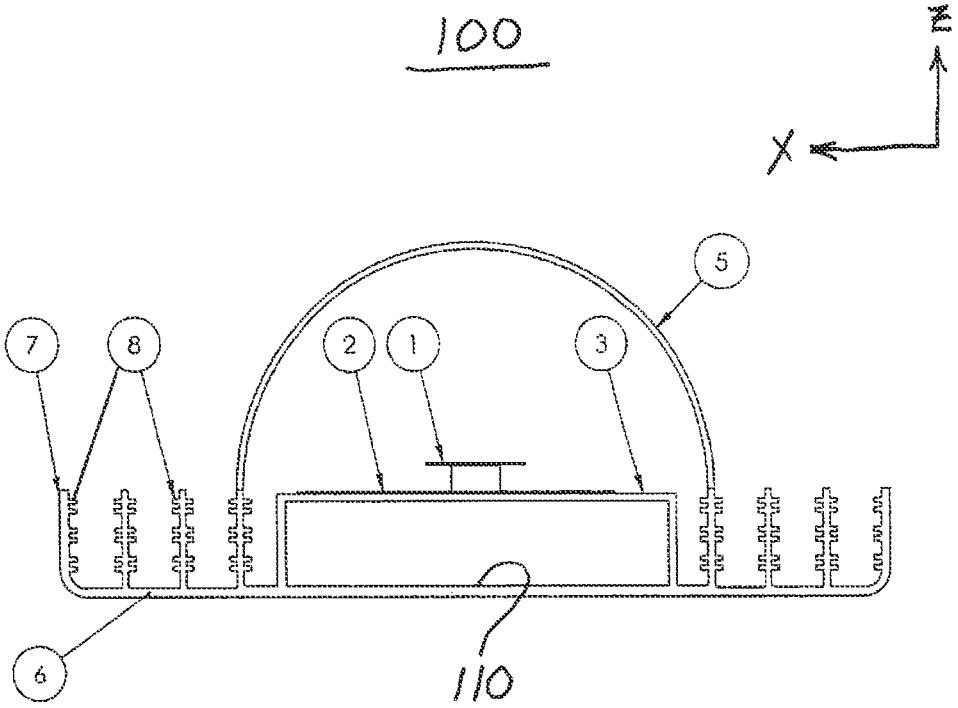
FIG. 3 is a plane view of the antenna configuration of FIG. 2.

FIG. 3 is a plane view of antenna 100, showing that walls 7 have protrusions 8 extending in a generally perpendicular direction from sides of walls 7, and thus generally parallel to planar surface 110. Protrusions 8 run along lengths of walls 7.

The presence of structure 6 minimizes radiation outside of a main lobe of antenna 100, and improves the front-to-back ratio of antenna 100 by interacting electromagnetically with an electromagnetic field of radiating element 1. Protrusions 8 further facilitate the effect of minimization of radiation outside of the main radiating lobe of antenna 100 and have influence on chosen dimensions of walls 7 and troughs 120.

Exact shape and dimensions of walls 7, their number and their position on antenna base 3, and dimensions and shape of protrusions 8 are determined by a suitable means, such as by optimization using electromagnetic field simulation software to match target radiation performance of particular antenna and its operating wavelength. Improvement of front-to-back ratio in range of 5-25 dB over standard value (the same antenna without structure 6) is achievable using structure 6.

Figure 4:
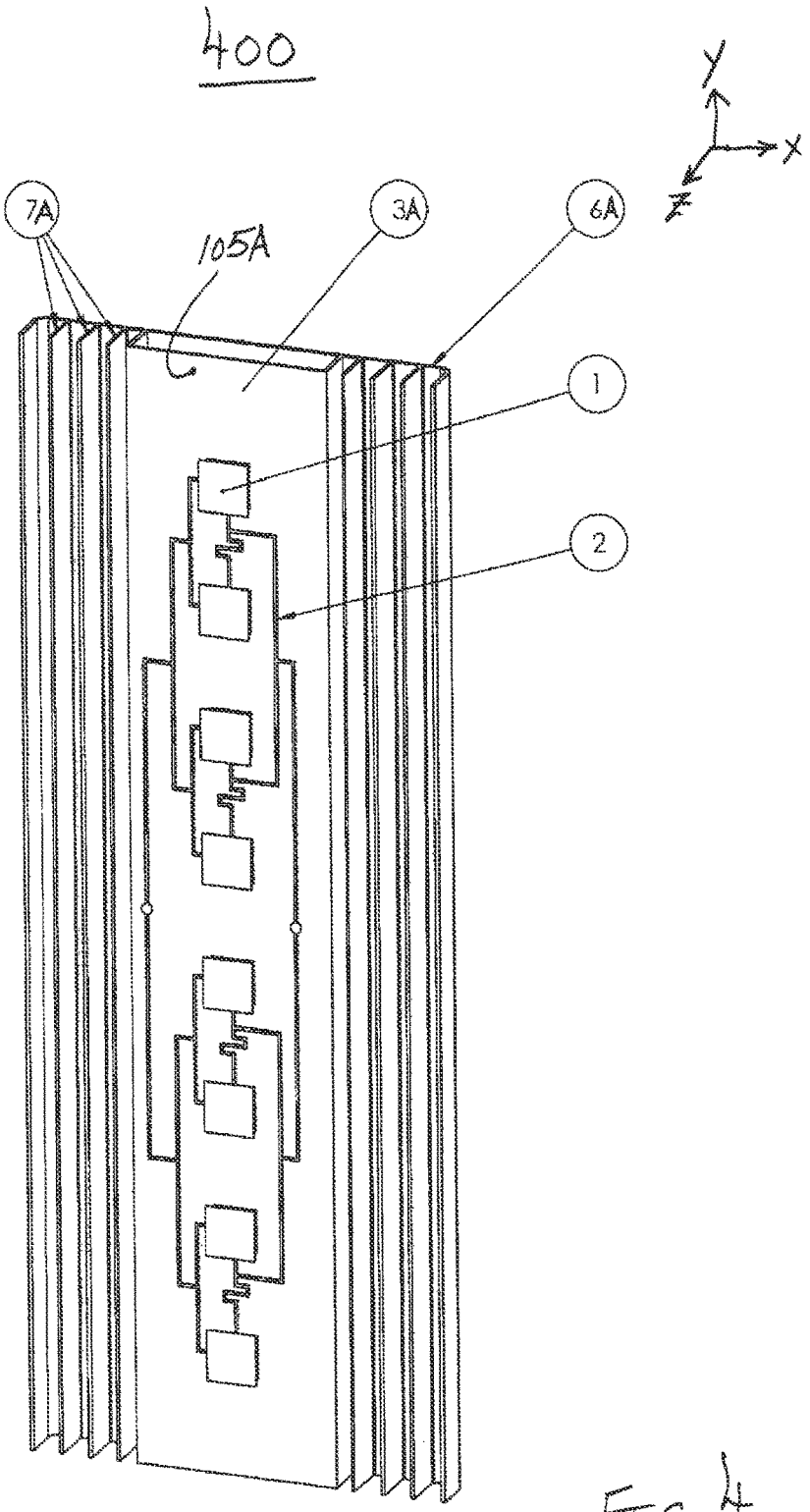
FIG. 4 is an illustration of another antenna.

FIG. 4 is an illustration of an antenna 400 that is similar to antenna 100, except that antenna 400, instead of having walls 7, has walls 7A that do not include protrusions 8. Thus, antenna 400 has an antenna base 3A and a structure 6A that are similar, but not identical, to antenna base 3 and structure 6, respectively. Structure 6A has a surface 105A that, like surface 105, may be of a form that is other than flat.

Figure 5:
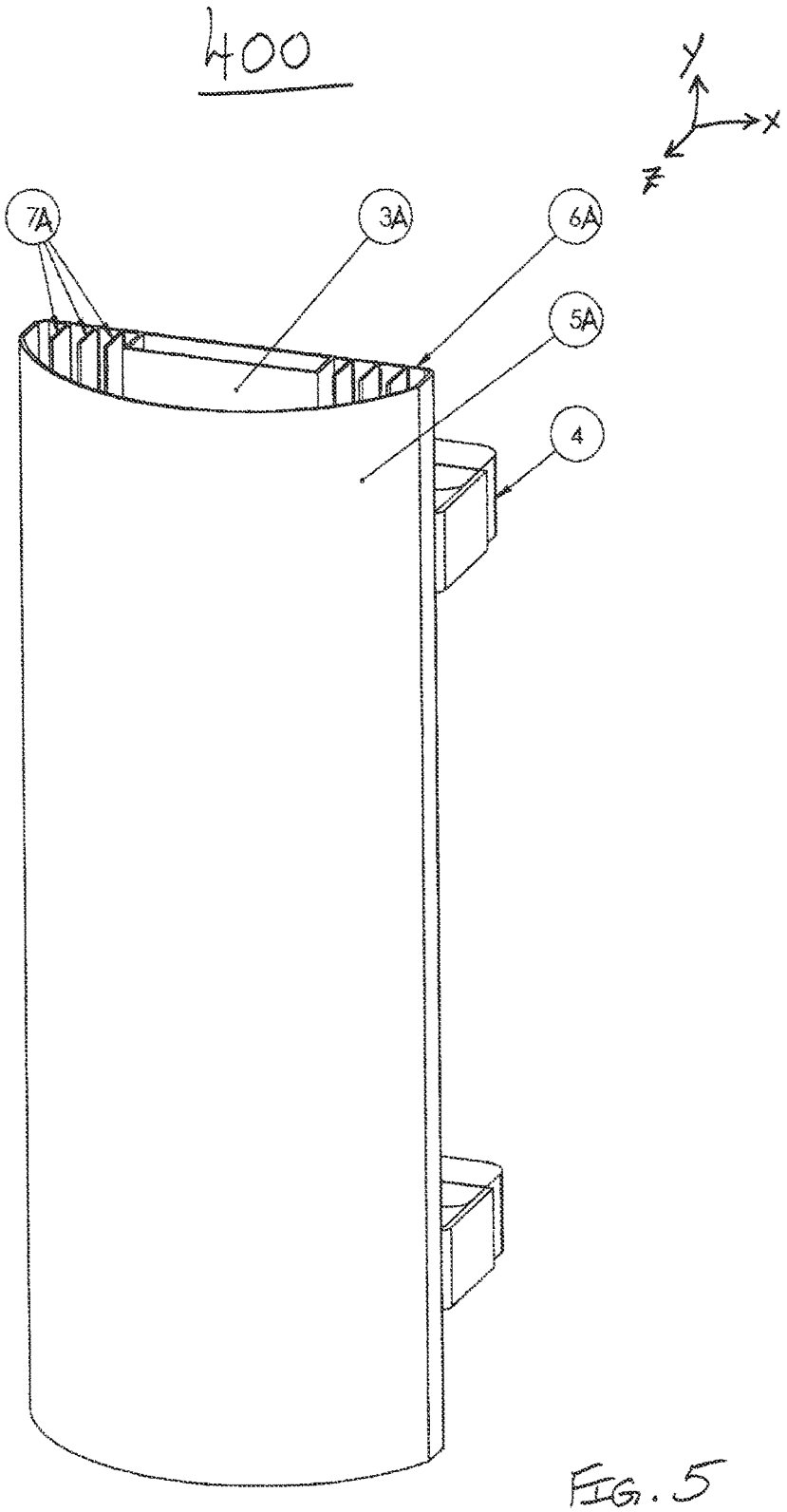
FIG. 5 is an illustration of the antenna of FIG. 4 having a radome.

FIG. 5 is an illustration of antenna 400 having a radome 5A that is similar to radome 5, but also covers walls 7A. Antenna 400 also includes an antenna mount 4 for securing antenna 400 to a structure such as a wall or a pole. Antenna 100 may also include antenna mount 4, or a mount that is similar to antenna mount 4.

Figure 6:
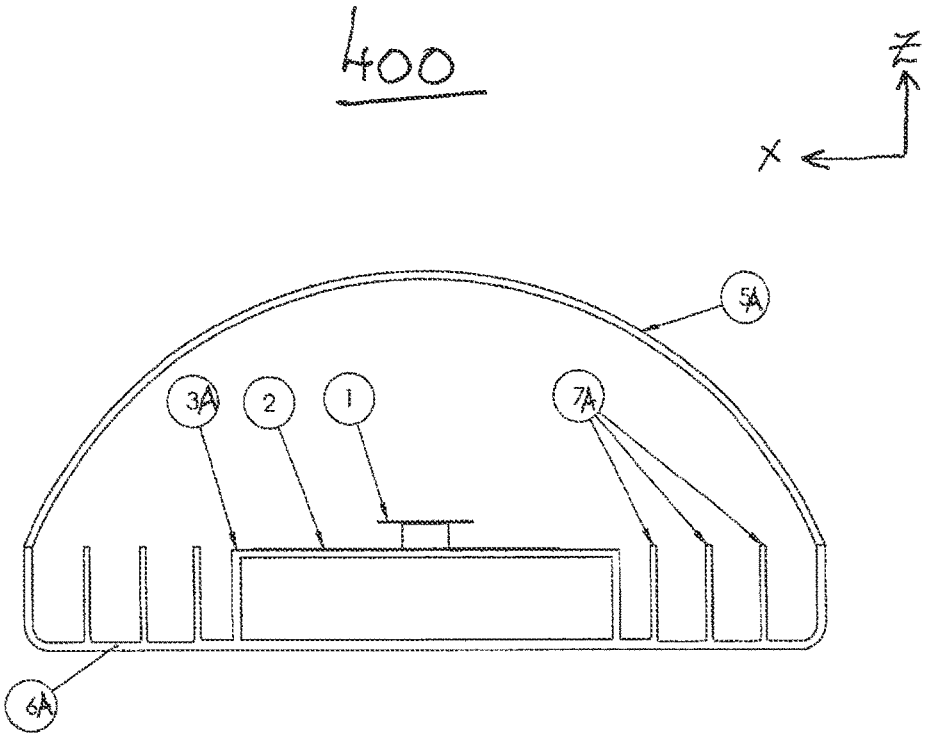
FIG. 6 is a plane view of the antenna configuration of FIG. 5.

FIG. 6 is a plane view of antenna 400.

Figure 7:
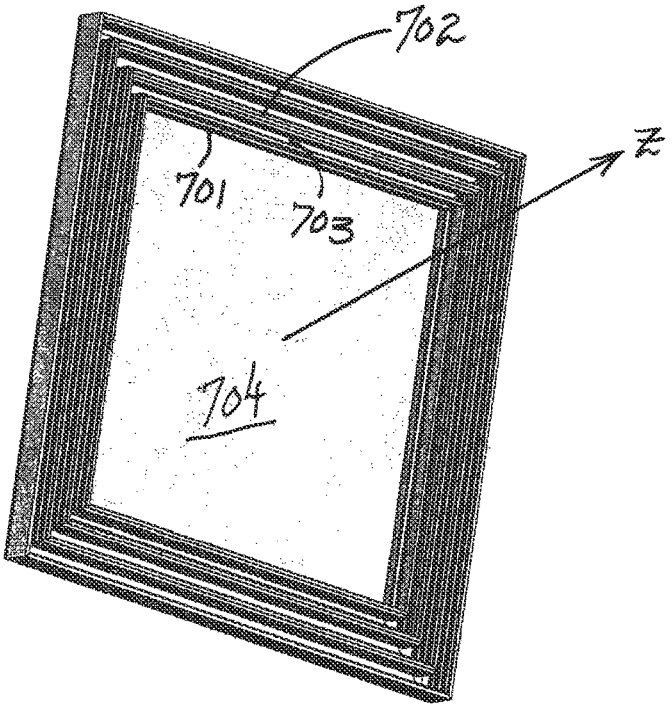
FIG. 7 is a perspective view of a structure that can be used in the antenna of FIG. 1.
Figure 7A:
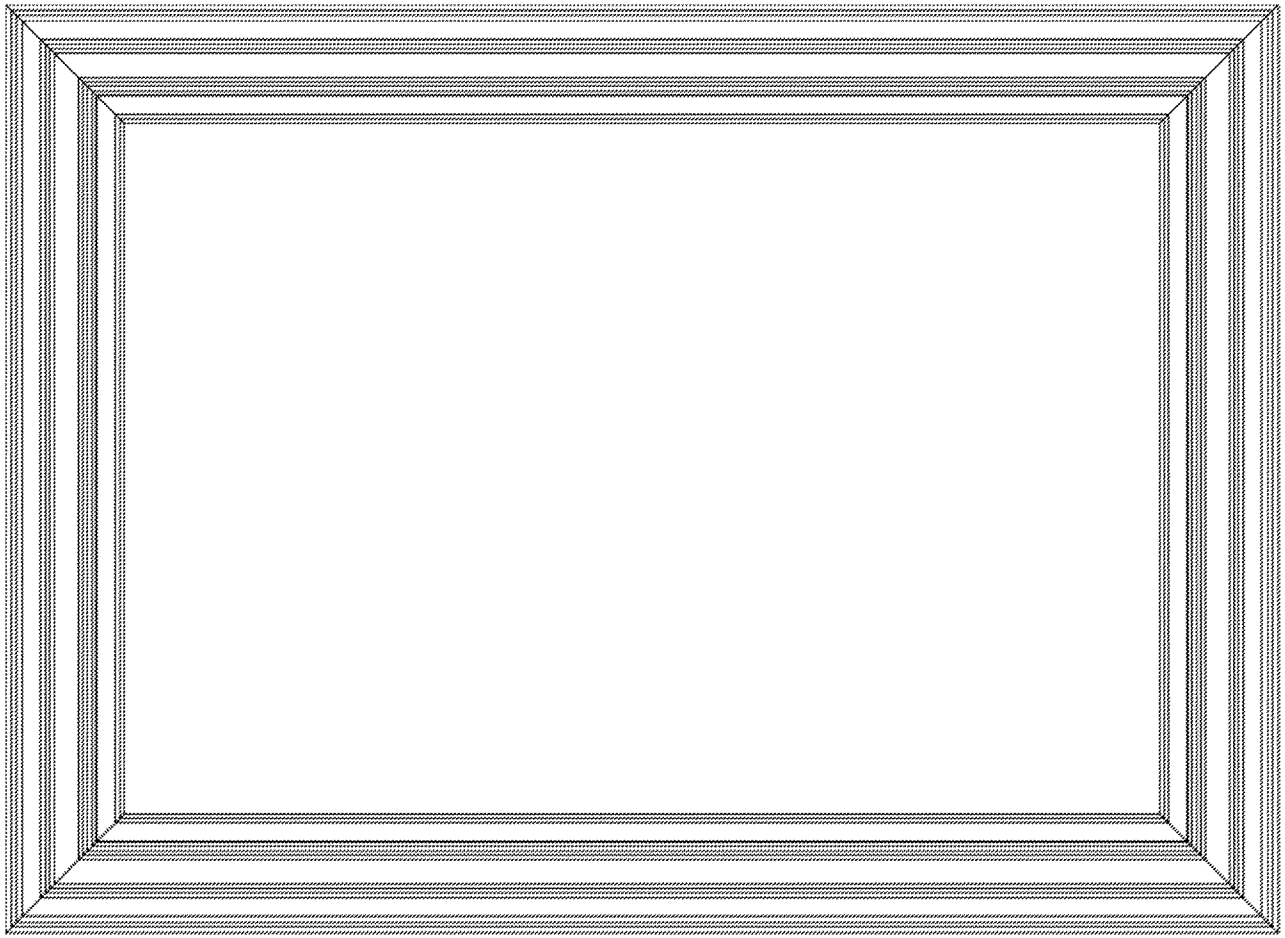
FIGS. 7A-7D are various views of the structure shown in FIG. 7.
Figure 7B:
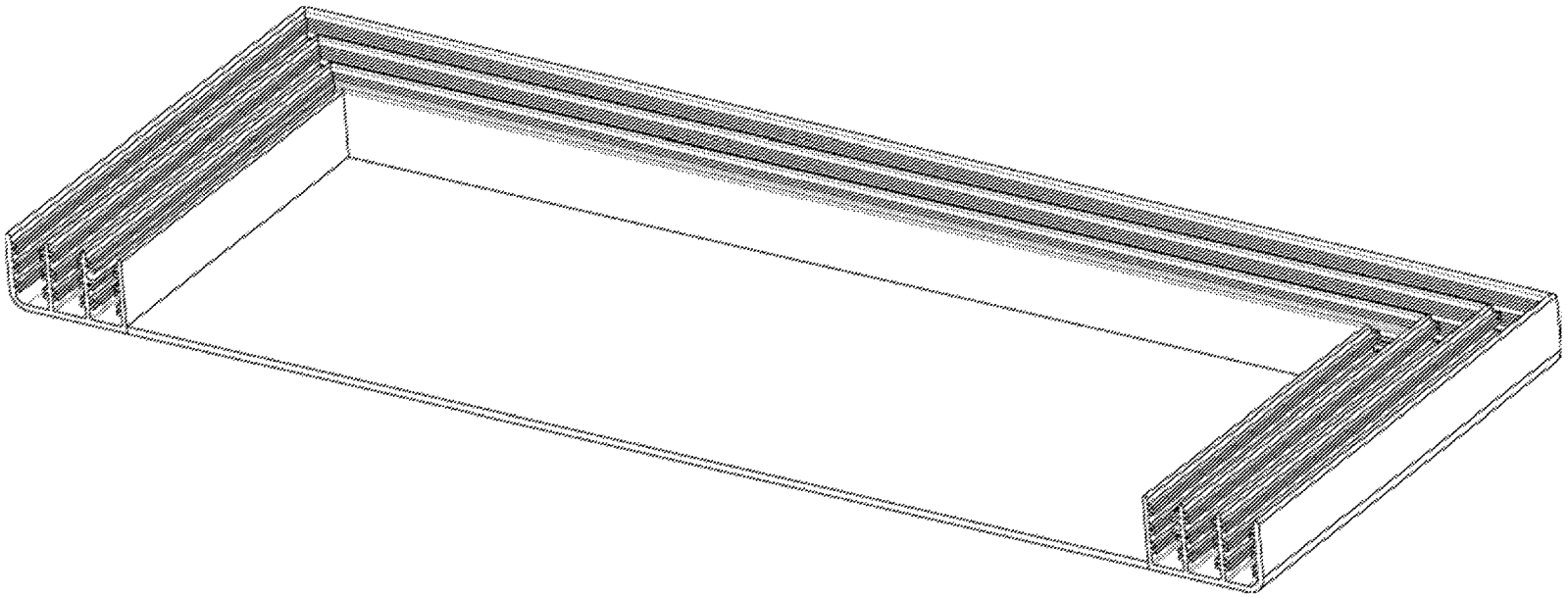
Figure 7C:
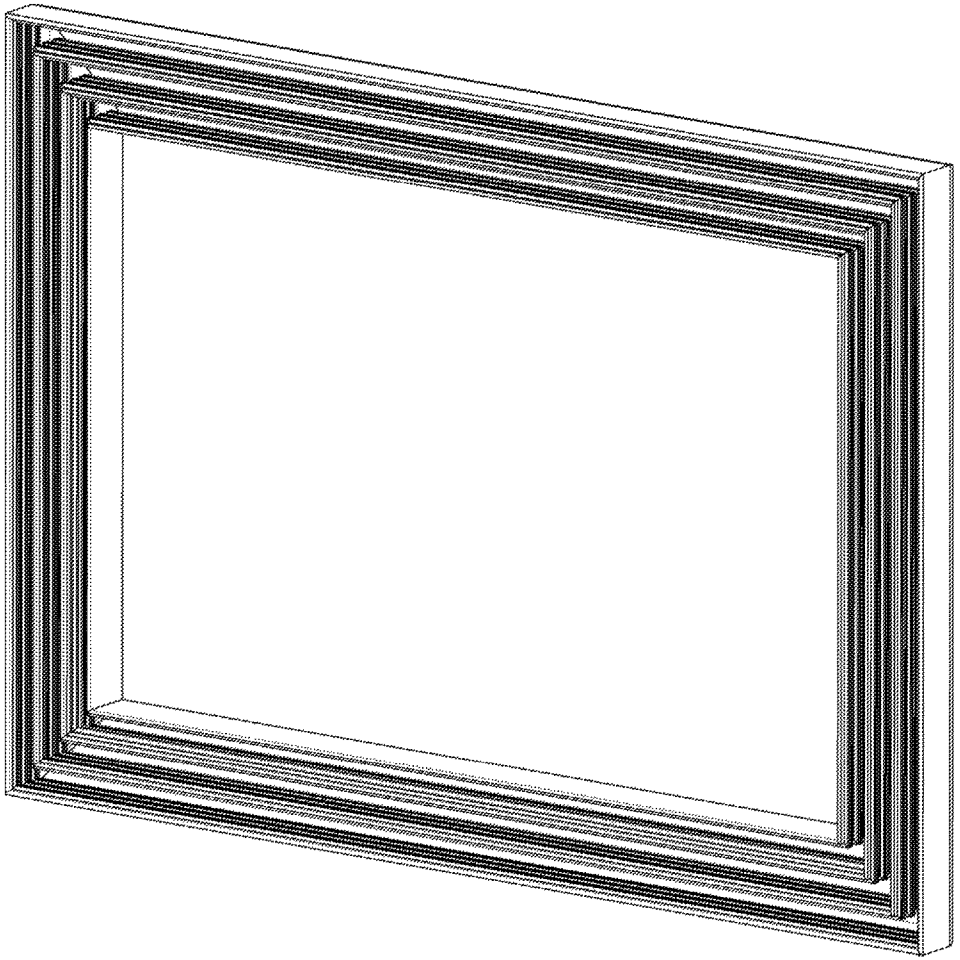
Figure 7D:
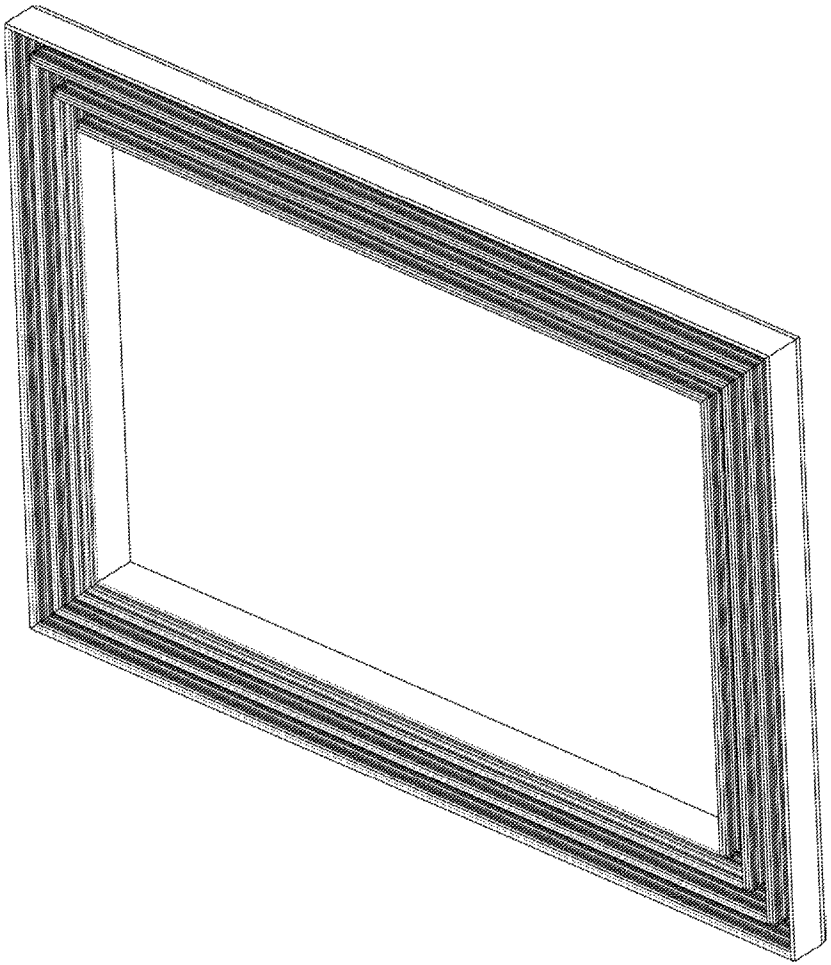

FIG. 7 is a perspective view of a structure 700 that can be used in antenna 100 in place of structure 6. Structure 700 is configurable of the same material as structure 6, has a surface 704 that is similar to surface 110, and has walls 701 and 702 that are generally perpendicular to surface 704. Wall 701 forms a rectangular perimeter that encompasses an area of surface 704, and wall 702 forms a rectangular perimeter that encompasses wall 701. Walls 701 and 702 are situated to form a trough 703 therebetween, such that trough 703 runs in a rectangular track between walls 701 and 702. Walls 701 and 702 may include protrusions similar to protrusions 8. There may be one or more additional walls that encompass walls 701 and 702 to form one or more additional troughs.

FIGS. 7A-7D are various views of structure 700.

Figure 8:
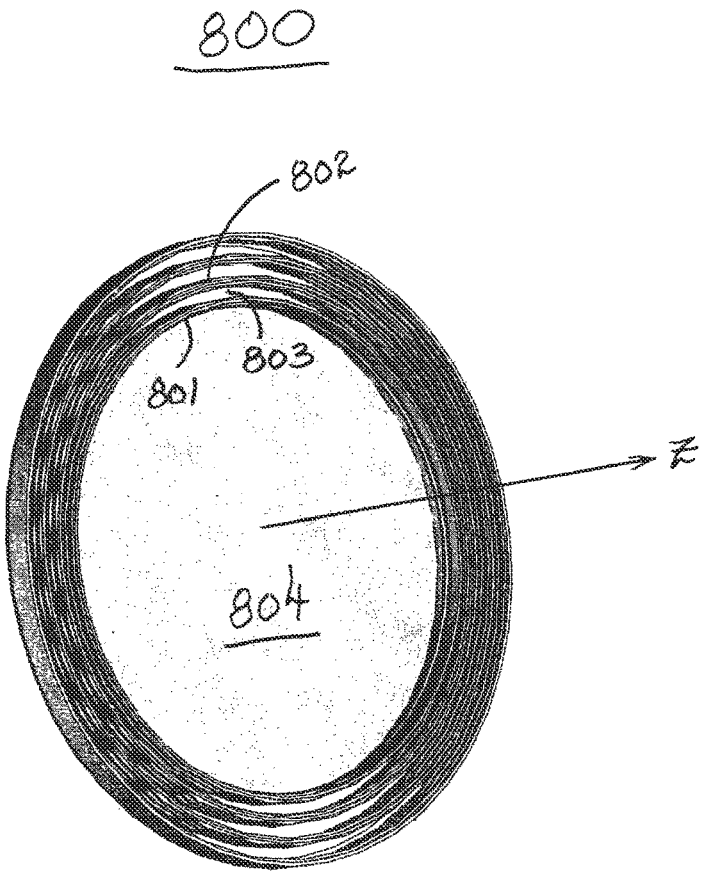
FIG. 8 is a perspective view of a structure that can be used in the antenna of FIG. 1.
Figure 8A:
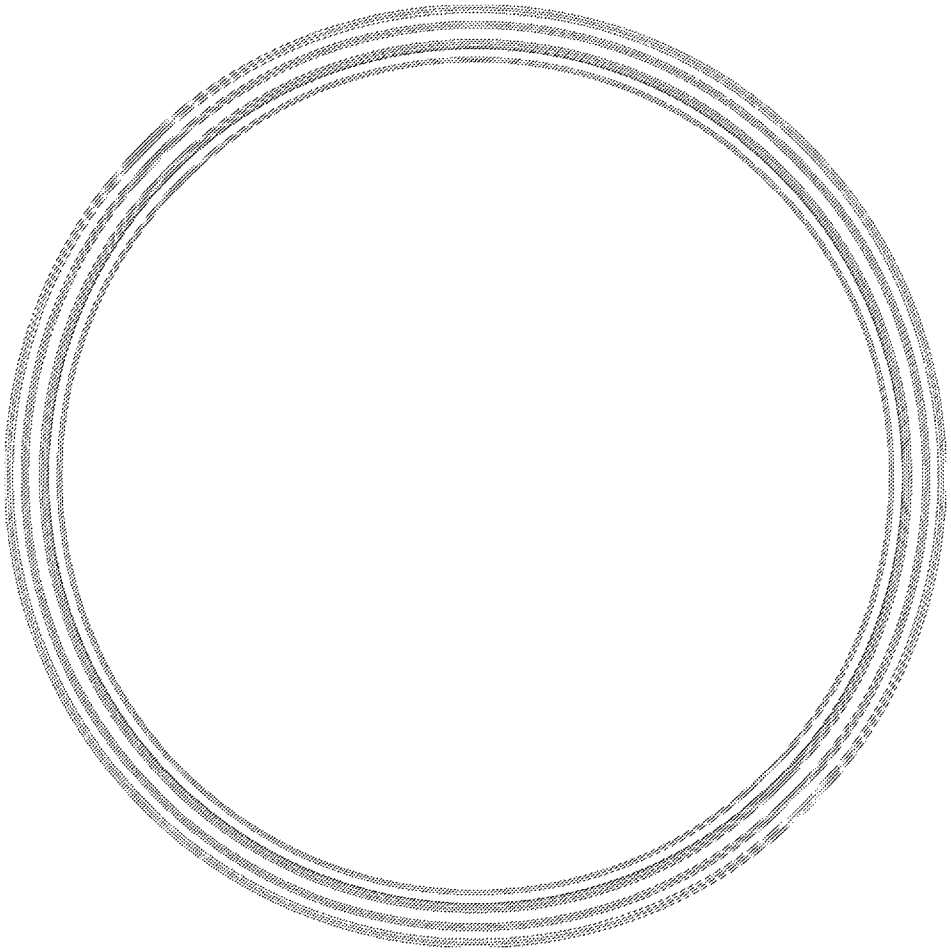
FIGS. 8A-8D are various views of the structure shown in FIG. 8.
Figure 8B:
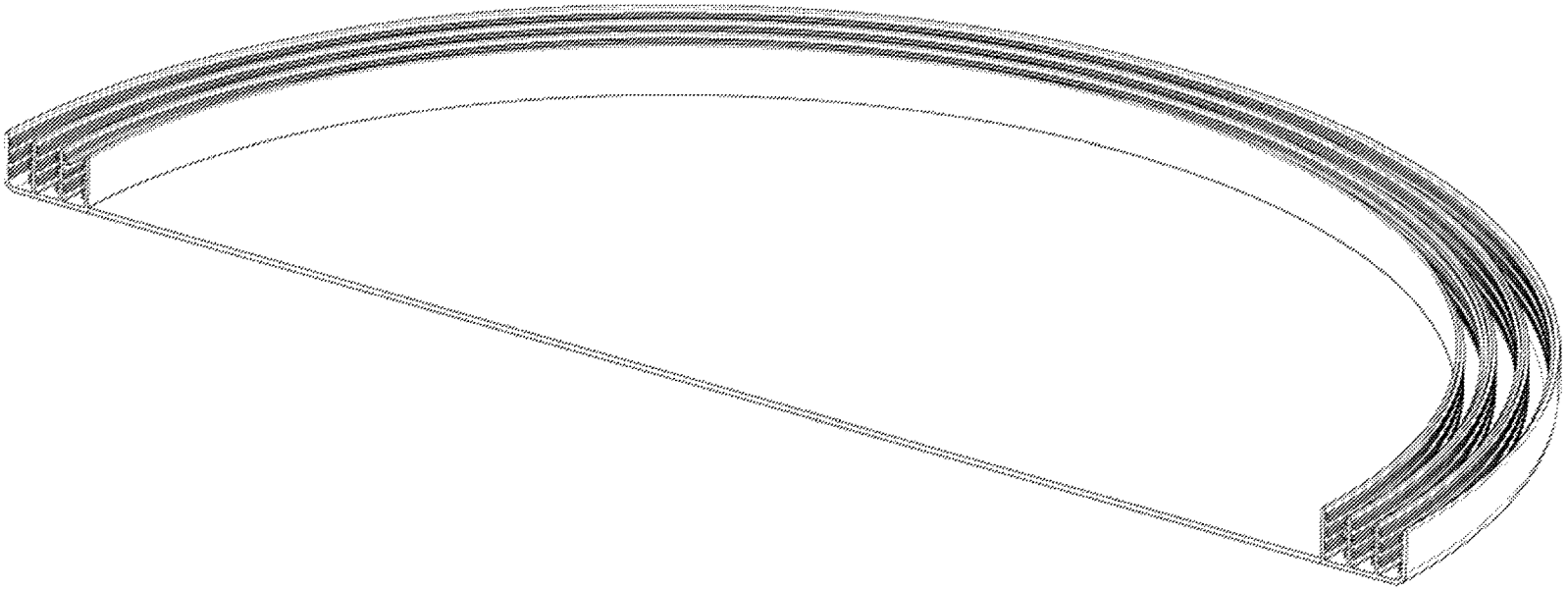
Figure 8C:
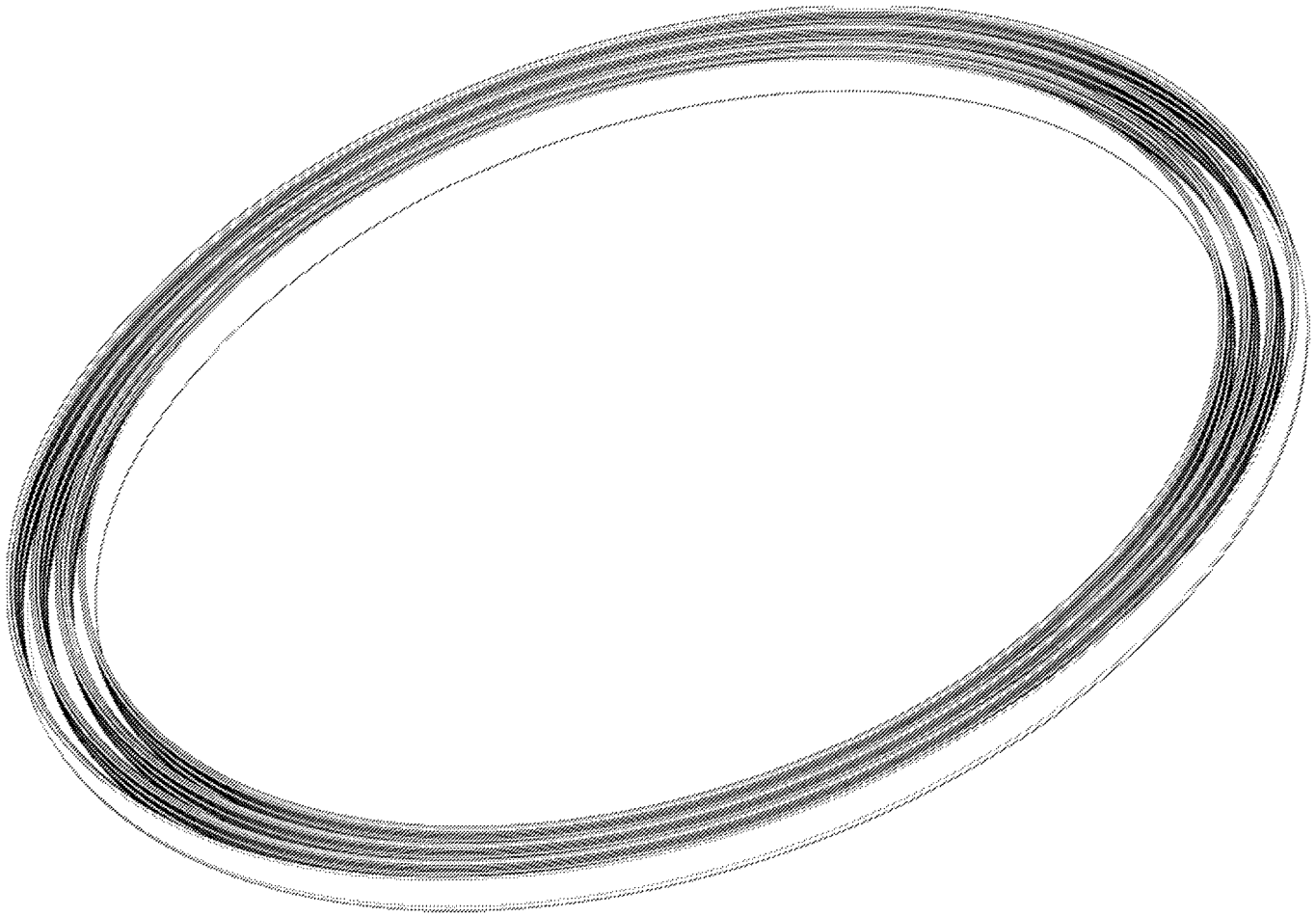
Figure 8D:
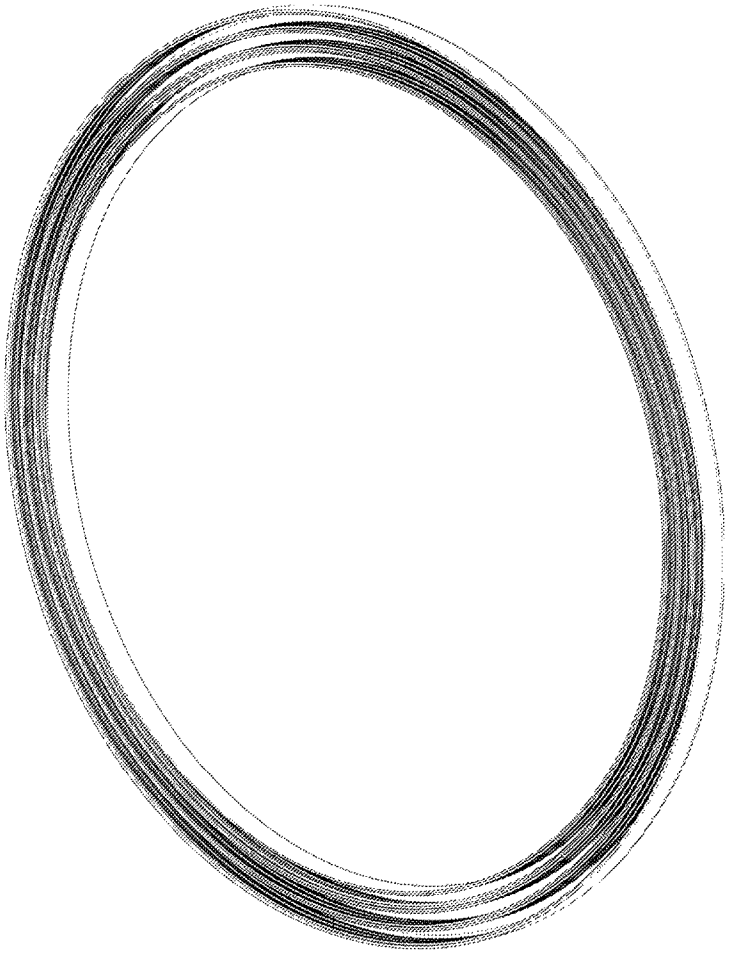

FIG. 8 is a perspective view of a structure 800 that can be used in antenna 100 in place of structure 6. Structure 800 is configurable of the same material as structure 6, has a surface 804 that is similar to surface 110, and has walls 801 and 802 that are generally perpendicular to surface 804. Wall 801 forms a circular perimeter that encompasses an area of surface 804, and wall 802 forms a circular perimeter that encompasses wall 801. Walls 801 and 802 are thus configured as concentric circles and are situated to form a trough 803 therebetween, such that trough 803 runs in a circular track between walls 801 and 802. Walls 801 and 802 may include protrusions similar to protrusions 8. There can be one or more additional walls that encompass walls 801 and 802 to form one or more additional troughs. As an alternative to forming circular perimeters, each of walls 801 and 802, and may be configured to form oval-shaped perimeters or elliptical perimeters so that trough 803 will run in an oval-shaped track or an elliptical track.

FIGS. 8A-8D are various views of structure 800.

The techniques described herein are exemplary, and should not be construed as implying any particular limitation on the present disclosure. It should be understood that various alternatives, combinations and modifications could be devised by those skilled in the art. For example, steps associated with the processes described herein can be performed in any order, unless otherwise specified or dictated by the steps themselves. The present disclosure is intended to embrace all such alternatives, modifications and variances that fall within the scope of the appended claims.

The terms "comprises" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles.

What is claimed is:

1. An antenna in a co-ordinate system having an x-axis, a y-axis and a z-axis situated orthogonally to one another, wherein said x-axis and said y-axis define an x-y plane, and wherein said antenna comprises:

- an element that emits radiation in a direction of said z-axis; and
- a structure made of an electrically conductive material, having:
  - a first surface situated in said x-y plane to a left side of said element;
  - a second surface situated in said x-y plane to a right side of said element;
  - a first wall, a second wall, a third wall and a fourth wall that are situated on said first surface; generally perpendicular to said first surface,
    - wherein said first wall and said second wall are parallel to one another and form a first trough therebetween,
    - wherein said second wall and said third wall are parallel to one another and form a second trough therebetween, and
    - wherein said third wall and said fourth wall are parallel to one another and form a third trough therebetween; and
  - a fifth wall, a sixth wall, a seventh wall and an eighth wall that are situated on said second surface, generally perpendicular to said second surface,
    - wherein said fifth wall and said sixth wall are parallel to one another and form a fourth trough therebetween,
    - wherein said sixth wall and said seventh wall are parallel to one another and form a fifth trough therebetween, and
    - wherein said seventh wall and said eighth wall to one another and form a sixth trough therebetween.

2. The antenna of claim 1, further comprising a feature selected from the group consisting of:

(a) a protrusion that runs a length of said first wall and protrudes, generally perpendicular to said first wall, into said first trough;

(b) protrusion that runs a length of said second wall and protrudes, generally perpendicular to said second wall, into said first trough;

(c) a protrusion that runs a length of said second wall and protrudes, generally perpendicular to said second wall, into said second trough;

(d) a protrusion that runs a length of said third wall and protrudes, generally perpendicular to said third wall, into said second trough;

(e) a protrusion that runs a length of said third wall and protrudes, generally perpendicular to said third wall, into said third trough;

(f) a protrusion that runs a length of said fourth wall and protrudes, generally perpendicular to said fourth wall, into said third trough (g) a protrusion that runs a length of said fifth wall and protrudes, generally perpendicular to said fifth wall, into said fourth trough;

(h) a protrusion that runs a length of said sixth wall and protrudes, generally perpendicular to said sixth wall, into said fourth trough;

(i) a protrusion that runs a length of said sixth wall and protrudes, generally perpendicular to said sixth wall, into said fifth trough;

(j) a protrusion that runs a length of said seventh wall and protrudes, generally perpendicular to said seventh wall, into said fifth trough;

(k) a protrusion that runs a length of said seventh wall and protrudes, generally perpendicular to said seventh wall, into said sixth trough; and (l) a protrusion that runs a length of said eighth wall and protrudes, generally perpendicular to said eighth wall, into said sixth trough.

3. An antenna in a co-ordinate system having an x-axis, a y-axis and a z-axis situated orthogonally to one another, wherein said x-axis and said y-axis define an x-y plane; and wherein said antenna comprises:

an element that emits radiation in a direction of said z-axis; and a structure made of an electrically conductive material, having:

a surface situated in said x-y plane; and a first wall, a second wall, a third wall and a fourth wall that are situated on said surface, generally perpendicular to said surface, wherein said first wall and said second wall are parallel to one another and form a first trough therebetween, wherein said second wall and said third wall are parallel to one another and form a second trough therebetween, wherein said third wall and said fourth are parallel to one another and form a third trough therebetween, and wherein said walls and said troughs run along perimeters that encompass an area of said surface.

4. The antenna of claim 3, wherein said perimeters are rectangular.

5. The antenna of claim 3, wherein said perimeters are circular.

6. The antenna of claim 3, wherein said perimeters are oval-shaped.

7. The antenna of claim 3, further comprising a feature selected from the group consisting of:

(a) a protrusion that runs a length of said first wall and protrudes, generally perpendicular to said first wall, into said first trough;

(b) a protrusion that runs a length of said second wall and protrudes, generally perpendicular to said second wall, into said first trough;

(c) a protrusion that runs a length of said second wall and protrudes, generally perpendicular to said second wall, into said second trough;

(d) a protrusion that runs a length of said third wall and protrudes, generally perpendicular to said third wall, into said second trough;

(e) a protrusion that runs a length of said third wall and protrudes, generally perpendicular to said third wall, into said third trough; and (f) a protrusion that runs a length of said fourth wall and protrudes, generally perpendicular to said fourth wall, into said third trough.

* * * * *